United States Patent [19]

Stephens

[11] 4,079,695

[45] Mar. 21, 1978

[54] DEVICE FOR MOISTENING THE ADHESIVE COATED ON STAMPS, LETTERS, ETC.

[76] Inventor: Ronald M. Stephens, 305-1400 Camosun, Victoria, British Columbia, Canada, V8V4L4

[21] Appl. No.: 756,263

[22] Filed: Jan. 3, 1977

[51] Int. Cl.[2] ..... B05C 1/02

[52] U.S. Cl. ..... 118/263; 118/268

[58] Field of Search ..... 118/264, 268, 266, 267, 118/243, 263

[56] References Cited

U.S. PATENT DOCUMENTS

| | | | |
|---|---|---|---|
| 1,004,660 | 10/1917 | Klotz | 118/267 X |
| 3,255,726 | 6/1966 | Stephens et al. | 118/263 X |

FOREIGN PATENT DOCUMENTS

| | | | |
|---|---|---|---|
| 387,061 | 2/1933 | United Kingdom | 118/268 |

*Primary Examiner*—John P. McIntosh

*Attorney, Agent, or Firm*—Seed, Berry, Vernon & Baynham

[57] ABSTRACT

A device for moistening water-soluble adhesives coated on envelopes, stamps, decals, tape or other such articles including a container holding water having a slot opening in the sidewall thereof through which a simulated tongue having a water absorbent wicking surface protrudes. The tongue is movable between a first position within the container and a second position wherein it protrudes from the container. Movement of the tongue is effected by an actuator either on the top or side of the container.

6 Claims, 6 Drawing Figures

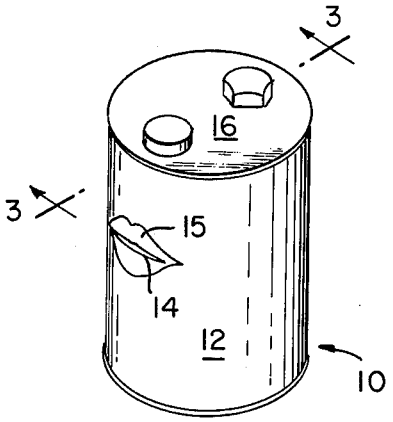
FIG. 1
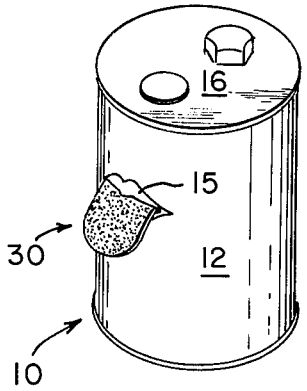
FIG. 2
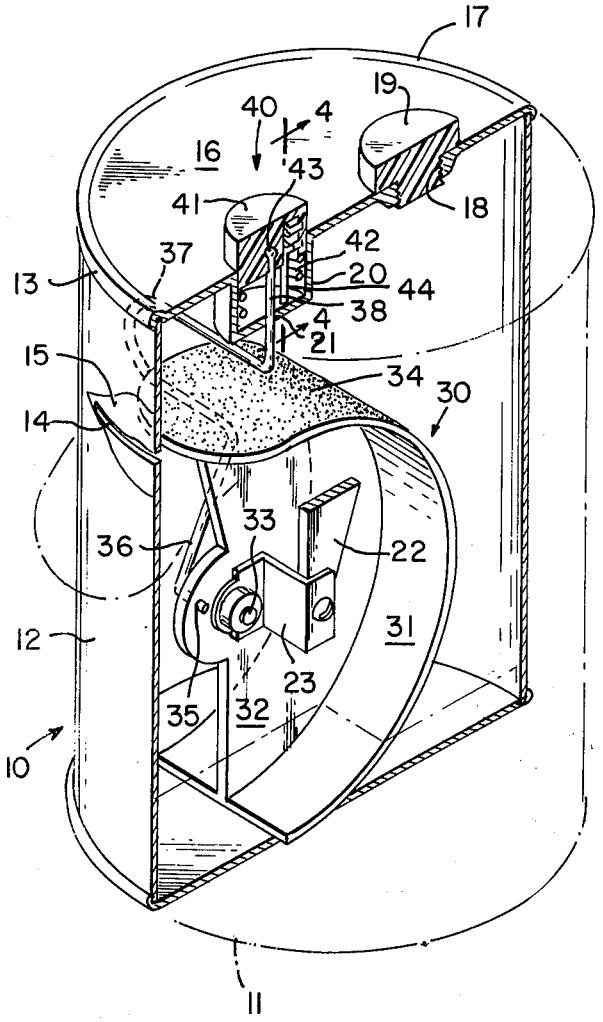
FIG. 3
FIG. 4
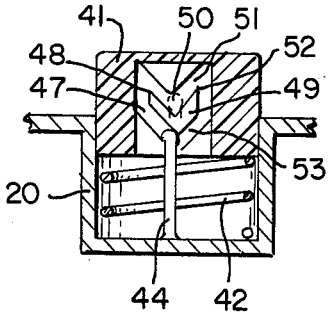

DEVICE FOR MOISTENING THE ADHESIVE COATED ON STAMPS, LETTERS, ETC.

BACKGROUND OF THE INVENTION

1. Field of the Invention

This invention relates to a novelty device useful for moistening water-soluble adhesives coated on stamps, decals, tape, etc.

2. Prior Art Relating to the Disclosure

Numerous means for moistening the water-soluble adhesives coated on the back surfaces of stamps, decals and on the flaps of envelopes are known. U.S. Pat. No. 1,429,058, for example, discloses a moistener for stamps in the form of a dog having an exposed tongue forming a stamp and envelope moistening surface. U.S. Pat. No. 954,651 also discloses a moistening device for stamps, envelopes and related articles.

SUMMARY OF THE INVENTION

A primary object of this invention is to provide a novelty device useful for moistening the water-soluble adhesive coated on stamps, decals, envelopes, tapes, etc., which is decorative, inexpensive to manufacture and of unique design.

A further object of this invention is to provide a novelty item utilizing a movable simulated tongue as the moistening surface for moistening the water-soluble adhesive coating on stamps, decals, etc., the tongue movable between a retracted position and a protruding position.

The novelty device comprises a container for holding water with an opening in the sidewall thereof. A member including a water absorbent surface with wicking action is mounted within the container so that one end of the member contacts the water in the container and the other end of the member protrudes through the opening. The member is mounted for movement between a first position within the container and a second position wherein one end of the member protrudes through the opening in the container. The member preferably simulates a tongue protruding through an opening in the container, the opening simulating a human mouth surrounded by lips.

BRIEF DESCRIPTION OF THE DRAWINGS

FIG. 1 is a perspective view of the novelty device with the simulated tongue retracted within the container;

FIG. 2 is a perspective view of the device of FIG. 1 with the simulated tongue protruding through the opening in the sidewall of the container;

FIG. 3 is a cross-sectional view of the device of FIG. 1 along sectionline 3—3 showing the mechanism for movement of the tongue;

FIG. 4 is a view along section line 4—4 of FIG. 3 illustrating the mechanism for activating the tongue member;

DESCRIPTION OF THE PREFERRED EMBODIMENTS

Figure 6:
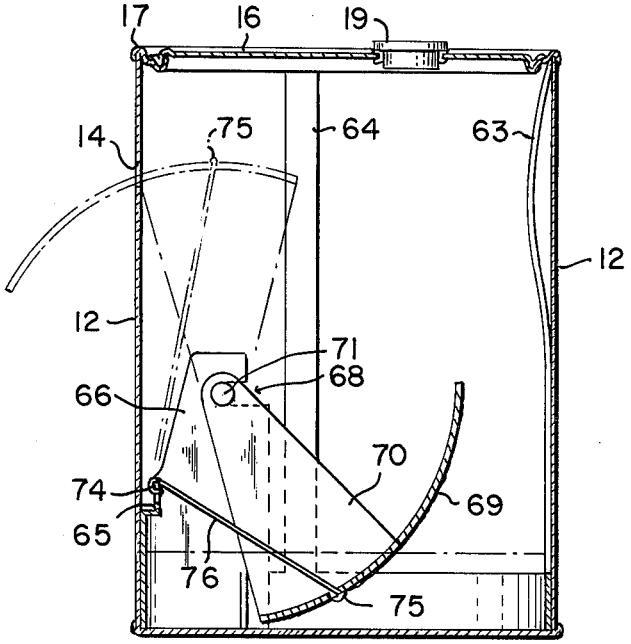
FIG. 6 is a cross-sectional view along section line 6—6 of FIG. 5.

Referring to the drawings the novelty device includes a container 10 in which is mounted a tongue assembly 30 and means 40 for moving the tongue member between a first position wherein the tongue member is retracted within the container and a second position wherein the tongue member protrudes through an opening in the container simulating a mouth. The container 10 may be fabricated from any desired material and be of any desired shape. The container illustrated is a cylindrical container. The container includes a bottom wall 11 and sidewall 12 having a top rim 13. An opening 14 is formed in the sidewall 12 of the container simulating a mouth opening. Around the opening may be placed a design 15 simulating human lips. The outer surface of the container 10 may be decorated in any desired manner.

The top of the container may be cast or injection molded in one piece from a suitable synthetic plastic material. The top includes a planar cover 16 having a crimped peripheral edge 17 adapted to be secured over the rim 13 of the container. The planar cover may also include a circular opening 18 into which a cap 19 is inserted. In FIG. 3 the opening 18 is threaded to receive the threaded cap 19 whereas in FIG. 6 the cap 19 is friction fitted into the opening 18.

Figure 5:
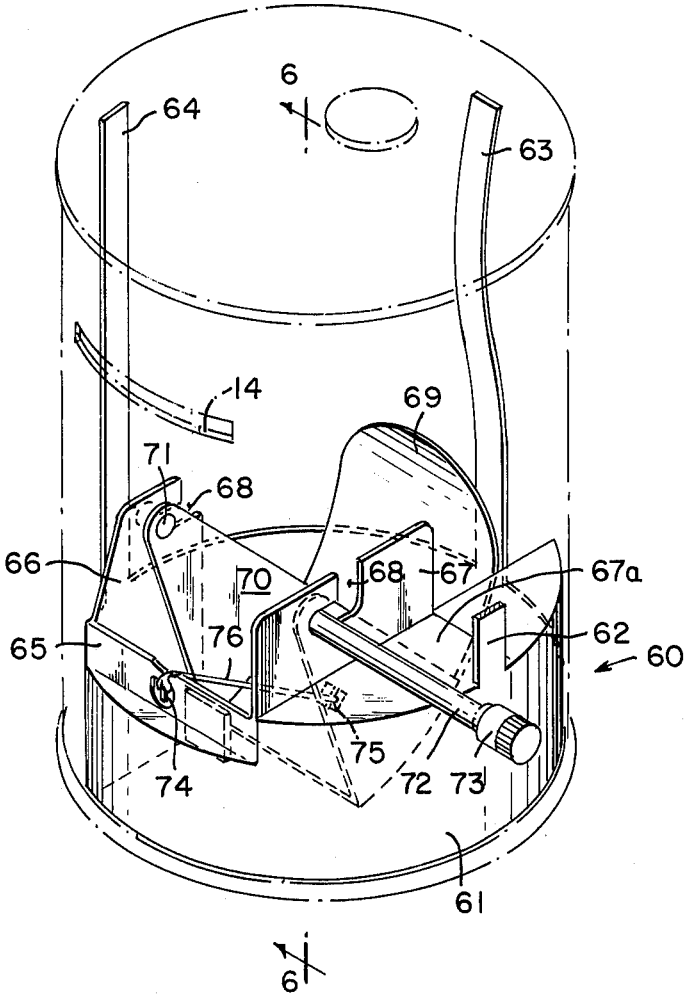
FIG. 5 is a perspective view of the novelty device employing an alternative mechanism for moving the tongue.

Alternative tongue assemblies are illustrated by FIG. 3 and FIG. 5. With respect to FIG. 3, the cover 16 includes a depressed portion 20 having an opening 21 in the base thereof for receiving an actuator as will be described. Integral, parallel, spaced supports 22 (only partially shown in FIG. 3) extend downwardly from the lower surface of the planar cover 16 a little over half of the distance of the height of the container 10. Inwardly directed flanges 23 are secured to the terminating ends of the supports 22, each having a slot opening therein for receiving and supporting the shaft of the movable tongue member as will be described. The tongue assembly 30 is rotatably supported by supports 22 for rotation between a retracted position illustrated in solid lines in FIG. 3 wherein the tongue member 31 is completely within the container and a protruded position illustrated in phantom lines in FIG. 3 wherein the end of the tongue member 31 projects through the opening 14 in the container. The tongue assembly 30 includes semicircular planar tongue member 31 having a width slightly less than the width of the opening 14 in the container. An integral support 32 for the tongue member is secured to the lower surface of the semicircular tongue member 31. A shaft 33 extends through the support 32 at the axis of the tongue member 31 and is secured to the supports 22 by press fittings. The upper surface of the tongue member 31 is covered with a water-absorbent wicking material 34 capable of wicking water from the bottom of the container to the opposite end of the tongue member. The wicking material may be any suitable wicking material. The support 32 includes an opening 35 offset from the axis of the tongue member for securing one end of a crank as will be described. The tongue member 31 is supported for rotation by the flanges 23 and supports 22 as illustrated.

Means are provided for moving the tongue assembly 30 between the retracted position and protruding position as illustrated. The means includes a crank 36 secured at one end to the support 32 through opening 35 offset from the axis of the support 32 and secured at the other end 38 to a push button assembly 40. The crank includes a U-shaped portion 37 intermediate of its ends to bypass the tongue assembly so as to not interfere with its operation.

The push button 41 of the push button assembly 40 is spring mounted in the depression 20 of cover 16 by spring 42. The end of the crank 38 includes a bulbous portion 43 secured to the underside of the push button by friction fitting it into an opening in the underside of the push button 41. The push button 41 includes a detent mechanism illustrated in more detail in FIG. 4. When the push button 41 is initially depressed it is held in the depressed position by the detent mechanism until again depressed, whereupon the detent releases the push button 41 for return to its initial position as urged by spring 42. When the push button is depressed it depresses the crank which rotates the tongue assembly from its retracted position to its protruding position as illustrated in FIG. 3.

The detent mechanism illustrated in FIG. 4 includes a flexible detent member 44 which travels in a predetermined path in the groove of a cam surface formed in the push button 41. When the push button 41 is in the position shown in FIG. 3 the detent rests at the lower end of the V-groove of the cam surface as illustrated. When the push button is depressed the detent is caused to travel along the side channel 47 of the V-groove until it is above the corner 48 of the V-island 49, at which time it snaps into the position 50 illustrated in phantom in FIG. 4 and is retained in that position by the pressure of spring 42 biasing the push button 41 upwardly. When push button 41 is again depressed the detent travels along channel 51 until it clears the corner 52 of the V-island 49. On release of the push button 41 the spring 42 urges the push button upwardly with the detent traveling in channel 53 to the position indicated.

The container is kept filled with water to a level such that the wicking material is submerged in the water at all times either in the retracted or extended positions.

FIGS. 5 and 6 illustrate an alternative mechanism for moving the tongue member between a first position wherein it is retracted within the container and a second position wherein a portion of it protrudes through the opening 14 and the container. The container used is essentially the same as that described with reference to FIG. 3. In this embodiment a base assembly 60, molded in one piece from a suitable plastic material, is fitted inside the container. The base assembly serves to support the tongue mechanism. The base assembly 60 includes a circular ring 61 having integral straps 62, 63 and 64 extending upwardly therefrom at spaced locations into contact with the cover 16, the cover retaining the ring 61 in position in the container by pressing down on the straps. The ring 61 should be sufficiently flexible to be reduced in diameter to be inserted through the flanged opening of the container 10. Upstanding flanges 66 and 67, integral with the circular base ring 61, include L-shaped slots 68 therein for supporting the tongue member 69. The lower edge of flange 67 is connected to the upper edge of ring 61 by a planar member **67*a* which acts as a baffle to keep water contained in the lower part of the container from splashing on the sidewalls thereof. The flanges 66 and 67 are connected by a planar member 65 having a central aperture therein bisected by a downward projecting finger 74. The finger serves as a retainer for one end of an elastic band 76 secured at its opposite end to the underside of the tongue member 69. The tongue member 69 is semi-circular and has a width slightly less than the width of the slot opening 14 in the container. Spaced supports 70 are secured to each side of the underside of the tongue member 69 at the end thereof opposite the portion of the tongue member which protrudes through the opening 14. The supports 70 are secured for rotation at their ends opposite attachment to the tongue member 69 in slots 68 of the upstanding flanges 66 and 67 by pin 71 and shaft 72. Shaft 72 extends laterally through an opening in the container wall 12 and includes a knob 73 for rotating the tongue member. An elastic band 76 is stretched between finger 74 and the underside of the tongue member 75 as illustrated in FIG. 6. The elastic band is mounted off-center so that when it is rotated to the position shown in phantom in FIG. 6 it will hold the tongue member in that position until the knob is rotated to retract the tongue member. For example, the distance between the point of attachment of the elastic band 74 to its point of attachment to the underside of the tongue member 75 illustrated in solid lines in FIG. 6 is about 2.4 inches. At about the midpoint of rotation of the tongue member from the position shown in solid lines to the position shown in phantom lines the distance is about 2.8 inches. The distance between the two points when the tongue member is in its protruded position shown in phantom in FIG. 6** is about 2.3 inches.

The container is filled with water to about the level shown by the dotted line in FIG. 6. The tongue member 69 includes a water absorbent material secured on its upper surface. When retracted the tongue member rests in the reservoir of water so that it remains saturated with water.

The embodiments of the invention in which a particular property or privilege is claimed are defined as follows:

1. A novelty device for moistening water-soluble adhesives coated on articles comprising:

a container holding water having a bottom wall, sidewalls and a top cover, the sidewall of the container having a horizontal slit opening therein resembling the opening of a human mouth, a semi-circular tongue member having a shaft secured through the central axis thereof and a planar portion on one end thereof resembling a tongue, the tongue member adapted to be mounted within the container for rotation about its central axis in the container between a first position wherein the tongue member is wholly within the container and in contact with the water in the container to a second position wherein the planar end of the tongue member protrudes through the horizontal slit opening in the sidewall of the container, spaced supports within the container for pivotally supporting the semi-circular tongue member about its central axis for rotation between the first and second positions, a water-absorbent wicking material secured to the upper surface of the semi-circular tongue member for absorbing water when in contact with the water in the container, and means to rotate the semi-circular tongue member about its central axis between the first and second positions.

2. The novelty device of claim 1 including a recess in the top cover, a spring biased actuator button located in the recess, a linkage secured at one end to the tongue member at a point laterally offset from its central axis and at the other end to the spring biased actuator so that depression of the actuator causes rotation of the tongue member from the first position to the second position and release of the actuator retracts the member to the first position, and means for retaining the spring biased actuator in a depressed position.

3. The novelty device of claim 1 wherein the shaft of the tongue member extends through the sidewall of the container and wherein an elastic band is secured at one end to a point adjacent the container wall and at the other end to the semi-circular tongue member, the elastic band mounted off-center with respect to the tongue member such that it will hold the tongue member in the second position until the shaft it rotated against the bias of the elastic band to move the tongue member from the second position to the first position.

4. The novelty device of claim 3 wherein the spaced supports within the container are joined by an intermediate linking member and wherein the elastic band is secured at the one end to the linking member.

5. The novelty device of claim 4 wherein the container is cylindrical and the top cover is removable.

6. The novelty device of claim 3 wherein the tongue member, in its first position, rests near the bottom wall of the container so that it is immersed in water at the bottom of the container until rotated from the first position to the second position to keep the wicking material on the tongue member wet at all times.

* * * * *